US005759759A

United States Patent [19]

Adin et al.

[11] Patent Number: 5,759,759

[45] Date of Patent: Jun. 2, 1998

[54] RADIOGRAPHIC ELEMENTS EXHIBITING INCREASED COVERING POWER AND COLDER IMAGE TONES

[75] Inventors: Anthony Adin, Rochester; Robert E. Dickerson, Hamlin; Marcia K. Hansen, Fairport, all of N.Y.

[73] Assignee: Eastman Kodak Company, Rochester, N.Y.

[21] Appl. No.: 864,088

[22] Filed: May 28, 1997

Related U.S. Application Data

[63] Continuation-in-part of Ser. No. 801,538, Feb. 18, 1997, abandoned.

[51] Int. Cl.[6] ..... G03C 1/04; G03C 1/06; G03C 1/09; G03C 1/005

[52] U.S. Cl. ..... 430/567; 430/627; 430/603; 430/966

[58] Field of Search ..... 430/567, 569, 430/603, 627, 966

[56] References Cited

U.S. PATENT DOCUMENTS

| | | | |
|---|---|---|---|
| 3,271,158 | 9/1966 | Allentoff | 430/567 |
| 3,272,631 | 9/1966 | Garrett et al. | 430/603 |
| 3,514,289 | 5/1970 | Goffe et al. | 430/638 |
| 4,013,470 | 3/1977 | Landon, Jr. | 430/523 |
| 4,414,304 | 11/1983 | Dickerson | 430/353 |
| 4,425,426 | 1/1984 | Abbott et al. | 430/502 |
| 4,803,150 | 2/1989 | Dickerson et al. | 430/502 |
| 5,252,442 | 10/1993 | Dickerson et al. | 430/502 |
| 5,292,627 | 3/1994 | Hershey et al. | 430/356 |
| 5,292,631 | 3/1994 | Hershey et al. | 430/567 |

FOREIGN PATENT DOCUMENTS

| | | |
|---|---|---|
| 1004302 | 9/1965 | United Kingdom . |
| 1049052 | 11/1966 | United Kingdom . |
| 1237541 | 6/1971 | United Kingdom . |
| 1269963 | 4/1972 | United Kingdom . |

OTHER PUBLICATIONS

Research Disclosure, vol. 184, Aug. 1979, Item 18431 E.

*Primary Examiner*—Mark F. Huff
*Attorney, Agent, or Firm*—Carl O. Thomas

[57] ABSTRACT

A dual-coated radiographic element is disclosed containing high bromide tabular grain emulsion layers exhibiting increased covering power and colder image tones. A covering power enhancing compound containing at least one divalent sulfur atom adsorbed to grain surfaces and a gelatino-vehicle are present in the emulsion layers. The emulsion layers additionally include a water soluble polymer chosen from the class consisting of polyacrylamide and dextran.

10 Claims, No Drawings

RADIOGRAPHIC ELEMENTS EXHIBITING INCREASED COVERING POWER AND COLDER IMAGE TONES

This is a continuation-in-part of U.S. Ser. No. 08/801,538, filed Feb. 18, 1997, now abandoned.

FIELD OF THE INVENTION

The invention relates to radiography. More specifically, the invention relates to silver halide emulsion layer containing radiographic elements.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

Covering power is defined as 100 times the ratio of maximum density to developed silver expressed in milligrams per square decimeter.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The terms "colder" and "warmer" in referring to image tone are used to mean CIELAB b* values measured at a density of 0.6 (single-sided) or 1.0 (dual-coated) above minimum density that are more negative or positive, respectively. The b* measurement technique is described by Billmeyer and Saltzman, *Principles of Color Technology*, 2nd. Ed., Wiley, N.Y., 1981, at Chapter 3. The b* values describe the yellowness vs. blueness of an image with more positive values indicating a tendency toward greater yellowness.

*Research Disclosure* is published by Kenneth Mason Publications, Ltd., Dudley House, 12 North St., Emsworth, Hampshire P010 7DQ, England.

BACKGROUND OF THE INVENTION

In medical diagnostic radiography the object is to obtain a viewable silver image from which a medical diagnosis can be made while exposing the patient to a minimal dose of X-radiation. Patient exposure to X-radiation is minimized by employing a dual-coated radiographic element in combination with front and back fluorescent intensifying screens. A portion of the X-radiation transmitted through the patient's anatomy is absorbed by each of the front and back intensifying screens. Each screen emits light in response to X-radiation exposure, and the emitted light from the front and back screens imagewise exposes the front and back emulsion layers of the dual-coated radiographic element. With this arrangement, patient exposure to X-radiation can be reduced to about 5 percent of the X-radiation exposure level that would be required for comparable imaging using a single emulsion layer and no intensifying screen.

Unlike photographic images, which are taken in small formats and then enlarged for viewing, radiographic images are normally viewed without enlargement. Thus, very large formats by photographic standards are required. Further, unlike color photography, wherein silver is reclaimed in processing, the silver in radiographic elements is often not reclaimed for years, since the images are required to be available to substantiate diagnoses. Further, usually a number of images are obtained when subject matter of pathological interest is observed.

Thus, there is in medical diagnostic imaging a need to minimize to the extent feasible the silver contained in the elements. As illustrated by Dickerson U.S. Pat. No. 4,414,304, it has been appreciated that high bromide tabular grain emulsions are ideally suited for medical diagnostic imaging, since these emulsions exhibit increased covering power. This allows reduction of the amount of silver that must be coated to produce a target maximum density level, which is typically in the range of from 3.0 to 4.0.

Dickerson demonstrates that covering power can be increased by decreasing the average thickness of the tabular grains employed in the emulsions. Unfortunately, the ability of film builders to lower the thickness of the tabular grains has been limited by another characteristic of these grains. That is, tabular grain emulsions have been recognized to have the undesirable characteristic of exhibiting increasingly warm image tones as average thickness is reduced. To satisfy radiologists' strong preference for colder (bluer black) image tones, radiographic supports are often blue tinted, and the average thickness of tabular grains is increased to higher levels than would be otherwise dictated by their performance properties.

A variety of organic addenda to silver halide emulsions are known to increase covering power. The water soluble polymers dextran, poly(vinylpyrrolidone) and polyacrylamide have been incorporated into emulsion layers to increase covering power, as illustrated by Allentoff et al U.S. Pat. No. 3,271,158, Garrett et al U.S. Pat. No. 3,272,631 and Goffe et al U.S. Pat. No. 3,514,289. Other covering power enhancing compounds are disclosed by *Research Disclosure*, Vol. 184, August 1979, Item 18431, E. Stabilization of Radiographic Materials Comprising Covering Power Addenda.

Hershey U.S. Pat. No. 5,292,631 discloses alkylthio-substituted azoles to be effective to increase the covering power of high bromide tabular grain emulsions. The alkylthio-substituted azoles are capable of forming relatively insoluble silver salts.

Hershey U.S. Pat. No. 5,292,627 discloses a sub-set of these same compounds, those in which the alkythio substituent is an alkylthioalkylthio substituent, to be useful to provide colder image tones in high bromide silver halide emulsions, provided the mean ECD of the grains is less than 0.3 μm. This, of course, excludes the vast majority of tabular grain emulsions, since the mean ECD of tabular grain emulsions is in all but very rare instances greater than 0.3 μm.

Compounds that contain a —S— or =S moiety are illustrated by U.K. Patents 1,004,302, 1,049,052, 1,237,541, and 1,269,9632, under at least some circumstances, to produce colder image tones and to increase silver image density (thereby increasing covering power).

Landon U.S. Pat. No. 4,013,470 employs heterocyclic mercaptans in combination with heterocyclic quaternary ammonium salts to obtain warmer image tones in a black-and-white print material.

From these teachings it is apparent that the art has by now studied the individual components known to be useful in high bromide silver halide emulsions. However, the teachings above demonstrate distinctive (and in some cases surprising) properties to arise from combinations of emulsion grains and addenda.

RELATED APPLICATION

Applicants' U.S. Ser. No. 08/864,421, filed concurrently herewith, a continuation-in-part of U.S. Ser. No. 08/801,767, filed Feb. 18, 1997, commonly assigned and now abandoned, titled RADIOGRAPHIC ELEMENTS EXHIBITING INCREASED COVERING POWER AND COLDER IMAGE TONES, discloses and claims a dual-coated radiographic element comprised of a blue tinted film support having coated on each of its faces a spectrally sensitized high bromide tabular grain emulsion. The properties of a maximum density of at least 3.0, an average contrast of at least 2.7, and a b* value more negative than −5.0 at a silver coating coverage on each major surface of the support of less than 12 mg/dm$^2$, are imparted by (1) the support having a neutral density of at least 0.18, (2) tabular grains accounting for at least 90 percent of total grain projected area having a mean thickness of 0.2 micrometer or less and a coefficient of variation of equivalent circular diameter less than 20 percent, (3) a covering power enhancing compound containing at least one divalent sulfur atom adsorbed to surfaces of the silver halide grains, (4) a water soluble polymer chosen from the class consisting of polyacrylamide and dextran, in a weight ratio of the polymer to the gelatino-vehicle of at least 0.1:1, and (5) hardening of the gelatino-vehicle being chosen to allow a weight gain following processing and before drying of greater than 200 percent, based on the total weight of gelatino-vehicle.

SUMMARY OF THE INVENTION

In one aspect this invention is directed to a radiographic element comprised of a transparent film support having first and second major surfaces and, coated on each of the major surfaces of the support, at least one layer containing a tabular grain emulsion including a gelatino-vehicle and silver halide grains having a mean equivalent circular diameter of greater than 0.3 micrometer and containing greater than 50 mole percent bromide and less than 3 mole percent iodide, based on silver, (a) adsorbed to surfaces of the silver halide grains a covering power enhancing compound containing at least one divalent sulfur atom, and (b) a water soluble polymer chosen from the class consisting of polyacrylamide and dextran, in a weight ratio of the polymer to the gelatino-vehicle of at least 0.1:1.

It has been discovered quite unexpectedly that, when either of the category (b) known covering power enhancing compounds polyacrylamide and dextran are added to a high bromide tabular grain emulsion already containing a conventional category (a) covering power enhancing compound, an unexpected colder image tone results. The result is quite unexpected, since neither polyacrylamide nor dextran have heretofore been recognized to be effective in producing colder image tones. In fact, the addition of polyacrylamide without a category (a) covering power enhancing compound actually produces a warmer image tone. Further, the demonstration in the Examples below that the water soluble polymers polyvinyl alcohol and poly (vinylpyrolidone), known to produce similar covering power advantages as polyacrylamide and dextran, markedly shift image tone toward warmer values, demonstrates the surprising properties of the radiographic elements of this invention.

DESCRIPTION OF PREFERRED EMBODIMENTS

An exposure assembly, including a dual-coated radiographic element satisfying the requirements of the invention, is schematically illustrated as follows:

| Assembly I |
|---|
| Front Screen Support (FSS) |
| Front Luminescent Layer (FLL) |
| Front Hydrophilic Colloid Layer Unit (FHCLU) |
| Transparent Film Support (TFS) |
| Back Hydrophilic Colloid Layer Unit (BHCLU) |
| Back Luminescent Layer (BLL) |
| Back Screen Support (BSS) |

A dual-coated radiographic element satisfying the requirements of the invention is formed by FHCLU, TFS and BHCLU. Prior to imagewise exposure to X-radiation, the dual-coated radiographic element, a front intensifying screen, formed by FSS and FLL, and a back intensifying screen, formed by BSS and BLL, are mounted in the orientation shown in a cassette (not shown), but with the screens and film in direct contact.

X-radiation in an image pattern passes through FSS and is, in part, absorbed in FLL. The front luminescent layer re-emits a portion of the absorbed X-radiation energy in the form of a light image, which exposes one or more silver halide emulsion layers contained in FHCLU. X-radiation that is not absorbed by the front screen passes through the dual-coated radiographic element with minimal absorption to reach BLL in the back screen. BLL absorbs a substantial portion of the X-radiation received and re-emits a portion of the X-radiation energy in the form of a light image that exposes one or more silver halide emulsion layers contained in BHCLU.

In the simplest possible construction of the radiographic elements of this invention each of FHCLU and BHCLU consist of a single tabular grain emulsion containing:

(a) adsorbed to surfaces of the silver halide grains a covering power enhancing compound containing at least one divalent sulfur atom and (b) a water soluble polymer chosen from the class consisting of polyacrylamide and dextran.

The category (a) component can be chosen from among a wide variety of compounds that absorb to silver halide grain surfaces and contain at least one divalent sulfur atom. The divalent sulfur atom can take the form of a —S— or =S moiety. When the sulfur atom is present as a —S— moiety, it typically links two carbon atoms, two nitrogen trivalent nitrogen atoms, or a carbon atom and a trivalent nitrogen atom. When the sulfur atom is present as a =S moiety, it forms a thioxocarbonyl (C=S) moiety. Most commonly the adsorbed covering power enhancer contains an azole or azine ring. The thioxocarbonyl and —S— can form a portion of the azole or azine ring. Additionally or alternatively the —S— moiety can be present in a ring substituent.

In one common form the adsorbed covering power enhancers are the 5-mercaptotetrazoles. In these compounds the 5-position divalent sulfur atom (—S—) can also, in one tautomeric form, rearrange to a thioxocarbonyl (C=S) moiety. As illustrated by U.K. Patent 1,004,302, cited above, 5-mercaptotetrazoles include the following representative compounds: 1-phenyl-5-mercaptotetrazole, 1-(α-naphthyl)-5-mercaptotetrazole, 1-cyclohexyl-5-mercaptotetrazole, 1-methyl-5-mercaptotetrazole, 1-ethyl-5-mercaptotetrazole, 1-allyl-5-mercaptotetrazole, 1-isopropyl-5-mercaptotetrazole, 1-benzoyl-5-mercaptotetrazole, 1-p-chlorophenyl-5-mercaptotetrazole, 1-p-methylphenyl-5-mercaptotetrazole, 1-p-methoxycarbonylphenyl-5-mercaptotetrazole, and 1-p-diethylaminophenyl-5-mercaptotetrazole.

In another form covering power enhancing agents satisfying category (a) requirements are dithioxotriazoles of the type disclosed by U.K. Patent 1,237,541, cited above. These compounds are 1,3,5-triazoles with two of the three ring carbon atoms forming thioxocarbonyl (C=S) moieties. Representative examples of these compounds include: 1-phenyl-2,4-dithioxo-1,2,3,4-tetrahydro-1,3,5-triazine, 1-cyclohexyl-2,4-dithioxo-1,2,3,4-tetrahydro-1,3,5-triazine, 1-benzyl-2,4-dithioxo-1,2,3,4-tetrahydro-1,3,5-triazine, and 1-p-tolyl-2,4-dithioxo-1,2,3,4-tetrahydro-1,3,5-triazine.

In an additional form the overall ring structure is that of an indene or indan, but with at least one nitrogen atom located in the five or six membered ring and, often, both of these rings. The sulfur atom is attached to a ring carbon atom adjacent a ring nitrogen atom.

In this form U.K. Patent 1,257,750, cited above, discloses 4,6-dimercapto-1,2,5,7-tetraazaindenes to be useful covering power enhancing addenda satisfying category (a). Specifically disclosed compounds include 1-R-4,6-dimercapto-1,2,5,7-tetraazaindenes, where R is hydrogen, methyl, phenyl, pyrimidin-4-yl, 3-carboxyphenyl, 4-carboxyphenyl, or 2,4-diphenyl-1,3,5-triazin-6-yl.

Another preferred form of tetraazaindenes for satisfying component (a) requirements are 1,3,3a,7- and 1,3,3a,4-tetraazaindenes with a mercapto (—SH) or substituted mercapto (—SR) substituent, where R is preferably alkyl of from 1 to 11 carbon atoms. These compounds include: 2,6-dimethyl-4-mercapto-1,3,3a,7-tetraazaindene, 5-ethyl-7-mercapto-6-methyl-1,3,3a,4-tetraazaindene, 5-bromo-4-mercapto-6-methyl-1,3,3a,7-tetraazaindene, 4-hydroxy-2-mercapto-6-methyl-1,3,3a,7-tetraazaindene, and analogues of the compounds that contain a $C_1$–$C_{11}$ alkyl substituent replacing the mercapto hydrogen atom. These and other useful tetraazaindene compounds are disclosed by Landon U.S. Pat. No. 4,013,470, Rowland et al U.S. Pat. No. 4,728,601, and Adin U.S. Pat. No. 5,256,519, the disclosures of which are here incorporated by reference.

It is additionally contemplated to employ category (a) covering power enhancers of the type disclosed by Hershey U.S. Pat. Nos. 5,292,627 and 5,292,631, the disclosures of which are here incorporated by reference. These covering power enhancers contain as a common feature a 1,2,4-triazole ring contains a 5-position substituent satisfying the formula:

$$T—[S—(CH_2)_p—]_n—S—L_m—$$

wherein

L is a divalent linking group containing from 1 to 8 carbon atoms (e.g., from 1 to 8 methylene groups);

m is 0 or 1;

n is an integer of from 0 to 4;

p is an integer of from 2 to 4; and

T is an aliphatic moiety (e.g., alkyl) containing from 1 to 10 carbon atoms.

The 1,2,4-triazole ring can contain an additional 3-position nitrogen atom to form a tetrazole ring. Additionally the triazole ring can be fused with an azine ring to form a 1,3,3a,7-tetraazaindene ring structure.

In another preferred form the indene type compound can contain a 1 or 3 ring position trivalent nitrogen atom and a 2 ring position mercapto (or substituted mercapto, as described above) substituent. Illustrative compounds include: 2-mercaptobenzoxazole, 2-mercaptobenzothiazole, and 2-mercaptobenzimidazole. These compounds are illustrated by Landon U.S. Pat. No. 4,013,470, cited and incorporated by reference above. In its "M" series of compounds Landon illustrates still other mercapto-substituted azole and azine useful in the practice of this invention.

As illustrated in the Examples below rhodanine, an azole ring compound that contains a thioxocarbonyl (C=S) ring member, is shown to be useful in the practice of this invention. The rhodanine ring has no corresponding mercapto tautomer. Thus, it is clear that a mercapto substituent is not an essential characteristic of the category (a) covering power enhancers. Other, comparable ring compounds having at least one thioxocarbonyl ring member include isorhodanine, 2- or 4-thiohydantoin, 2-thiooxazolidine-2,4-dione, and 2-thiobarbituric acid.

Each of these ring structures are common acidic nuclei of merocyanine dyes. Thus, it is specifically recognized that the category (a) covering power enhancer can, if desired, include the substituents necessary to complete a merocyanine dye chromophore. The following are illustrations of merocyanine dyes that can be used as category (a) covering power enhancers:

D-1 5-[(3-Ethyl-2[3H]-benzoxazolidene)ethylidene]-rhodanine;

D-2 5-p-Diethylaminobenzylidene-2-thiobarbituric acid;

D-3 3-Ethyl-5-[(3-ethyl-2[3H]-benzoxazolidene) ethylidene]rhodanine;

D-4 3-Ethyl-5-[(3-methyl-2[3H]-thiazolylidene)ethylidene] rhodanine;

D-5 3-Carboxymethyl-5-(3-methyl-2[3H]-benzothiazolidene)rhodanine;

D-6 3-Ethyl-5-[(3-ethyl-2[3H]-benzoxazolylidene) ethylidene]-1-phenyl-2-thiohydantoin;

D-7 3-Ethyl-5-[(3-methyl-2[3H]-thiazolinylidene) ethylidene]-2-thio-2,4-oxazolidinedione;

D-8 3-Ethyl-5-[(1-ethylnaphtho[1,2-d]thiazolin-2-ylidene)-1-methylthethylidene]rhodanine;

D-9 3-Ethyl-5-(3-piperidinoallylidene)rhodanine;

D-10 5-(3-Ethyl-2[3H]-benzoxazolylidene)-3-phenylrhodanine;

D-11 3-Ethyl-5-(1-ethyl-4[1H]-pyridylidene)rhodanine;

D-12 3-Ethyl-5-[(1-piperidyl)methylene]rhodanine;

D-13 3-Ethyl-5-[4-(3-ethyl-2-benzoselenazolinylidene)-2-butenylidene]-1-phenyl-2-thiohydantoin;

D-14 5-[(3-Ethyl-2[3H]-benzothiazolylidene)ethylidene-3-n-heptyl-1-phenyl-2-thiohydantoin;

D-15 5-[(3-Ethyl-2[3H]-benzothiazolylidene)ethylidene]-3-n-heptyl-1-phenyl-2-thio-2,4-dioxaxolidenedione;

D-16 5-[(1,3,3-Trimethyl-2-indolinylidene)ethylidene-rhodanine;

D-17 Bis[1,3-diethyl-2-thiobarbituric acid-(5)]-pentamethineoxonol;

D-18 5-[(3-Ethyl-2[3H]-benzoxazolylidene)ethylidene]-3-β-sulfoethyl-2-thio-2,4-oxazolidenedione;

D-19 3-Carboxymethyl-5-[(3-methyl-2[3H]-benzoxazolidene)ethylidene]rhodanine; and D-20 5-(3-Ethyl-2-benzothiazolinylidene)-3-β-sulfoethylrhodanine.

Generally any conventional covering power enhancing amount of the component (a) can be incorporated in the emulsion layers of the radiographic elements of the invention. Generally concentrations of component (a) ranging from 20 to 2000 mg/Ag mole are effective, with concentrations of from 30 to 700 mg/Ag mole being preferred.

The category (b) addenda are water soluble polymers. The water soluble polymers polyacrylamide and dextran have been found to be effective. Any form of these polymers that can be dissolved in the emulsion can be employed in the practice of the invention. Useful concentrations of the category (b) addenda include at least a 0.1:1 weight ratio of the category (b) component to gelatino-vehicle in the emulsion layer. The component (b) to gelatino-vehicle weight ratio is contemplated to range from 0.1:1 to 1:1 for the majority of applications, with a weight ratio of from 0.25:1 to 0.75:1 being preferred.

The high bromide tabular grain emulsions contain in addition to components (a) and (b) a gelatino-vehicle (c) and high bromide grains (d), including tabular grains. The grains contain greater than 50 mole percent bromide, based on silver, and less than 3 mole iodide, based on silver. Any halide other than bromide and iodide can be chloride and can account for up to (but not including) 50 mole percent of total halide, based on silver. Preferably chloride, if present, is limited to less than 10 mole percent, based on silver. Preferred silver halide grain compositions are silver bromide and silver iodobromide, with silver chlorobromide, silver iodochorobromide and silver chloroiodobromide also being contemplated.

Tabular grains account for at least 50 percent of total grain projected area. Preferably tabular grains account for at least 70 percent and optimally at least 90 percent of total grain projected area. In highly uniform grain emulsions tabular grains have been observed to account for substantially all (>97%) of total grain projected area.

The tabular grains have a mean ECD ranging up to 10 μm. In practice, mean ECD's seldom exceed 5 μm. The emulsions in the radiographic elements of this invention in all instances exhibit a mean ECD of greater than 0.3 μm.

The mean thickness (t) of the tabular grains is less than 0.3 μm. Preferred tabular grain emulsions contain thin tabular grains having mean thicknesses of less than 0.2 μm. By reason of the colder image tones exhibited by the tabular grain emulsions of this invention, mean tabular grain thicknesses of less than 0.1 μm are specifically contemplated.

The emulsion grains are suspended in a gelatino-vehicle. The vehicle can be gelatin—e.g., alkali-treated gelatin (cattle bone or hide gelatin) or acid-treated gelatin (pigskin gelatin)—or gelatin derivatives—e.g., acid-treated gelatin, such as acetylated gelatin or phthalated gelatin.

Components (c) and (d) as well as other conventional emulsion features, such as chemical and spectral sensitization of the grains, hardeners, antifoggants and stabilizers, and the like, are present in conventional high bromide emulsions used in radiographic and photographic elements. Such emulsions are described in greater detail in the following patents, the disclosures of which are here incorporated by reference:

| | |
|---|---|
| Dickerson | U.S. Pat. No. 4,414,310; |
| Abbott et al | U.S. Pat. No. 4,425,425; |
| Abbott et al | U.S. Pat. No. 4,425,426; |
| Kofron et al | U.S. Pat. No. 4,439,520; |
| Wilgus et al | U.S. Pat. No. 4,434,226; |
| Maskasky | U.S. Pat. No. 4,435,501; |

-continued

| | |
|---|---|
| Maskasky | U.S. Pat. No. 4,713,320; |
| Dickerson et al | U.S. Pat. No. 4,803,150; |
| Dickerson et al | U.S. Pat. No. 4,900,355; |
| Dickerson et al | U.S. Pat. No. 4,994,355; |
| Dickerson et al | U.S. Pat. No. 4,997,750; |
| Bunch et al | U.S. Pat. No. 5,021,327; |
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,659; |
| Dickerson et al | U.S. Pat. No. 5,252,442; |
| Dickerson | U.S. Pat. No. 5,391,469; |
| Dickerson et al | U.S. Pat. No. 5,399,470; |
| Maskasky | U.S. Pat. No. 5,411,853; |
| Maskasky | U.S. Pat. No. 5,418,125; |
| Daubendiek et al | U.S. Pat. No. 5,494,789; |
| Olm et al | U.S. Pat. No. 5,503,970; |
| Wen et al | U.S. Pat. No. 5,536,632; |
| King et al | U.S. Pat. No. 5,518,872; |
| Fenton et al | U.S. Pat. No. 5,567,580;. |
| Daubendiek et al | U.S. Pat. No. 5,573,902; |
| Dickerson | U.S. Pat. No. 5,576,156; |
| Daubendiek et al | U.S. Pat. No. 5,576,168; |
| Olm et al | U.S. Pat. No. 5,576,171; |
| Deaton et al | U.S. Pat. No. 5,582,965. |

The patents to Abbott et al, Fenton et al, Dickerson and Dickerson et al disclose radiographic elements of type useful in the practice of the invention and are therefore cited and incorporated by reference to show conventional element features in addition to the gelatino-vehicle and high bromide tabular grain emulsions.

TFS can be selected from conventional transparent radiographic film supports. Typically these supports consist of a transparent flexible film having subbing layer coated on its opposite major faces to improve adhesion by hydrophilic colloids. In many instances the surface coating on the transparent film support is itself a hydrophilic colloid layer, but highly hardened so that it is not processing solution permeable. Radiographic film supports usually exhibit the following distinguishing features: (1) the film support is constructed of polyesters to maximize dimensional integrity rather than employing cellulose acetate support as are most commonly employed in photographic elements and (2) the film supports are blue tinted to contribute toward the cold image tones desired, whereas photographic film supports are rarely, if ever, blue tinted. Radiographic film supports, including the incorporated blue dyes that contribute to cold image tones, are described in *Research Disclosure*, Vol. 184, April 1979, Item 18431, Section XII. *Research Disclosure*, Item 38957, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthalate) are specifically preferred polyester film supports.

Although the front and back hydrophilic colloid layer units FHCLU and BHCLU can consist solely of a high bromide tabular grain emulsion layer as described above, in preferred embodiments the hydrophilic colloid layer units are expanded into multiple layers, as shown in preferred radiographic element PRE-1, shown below:

| PRE-1 |
|---|
| Protective Layer Unit (PLU) |
| Tabular Grain Emulsion Layer (TGREL) |
| Underlying Layer Unit (ULU) |
| Transparent Film Support (TFS) |
| Underlying Layer Unit (ULU) |
| Tabular Grain Emulsion Layer (TGREL) |
| Protective Layer Unit (PLU) |

Instead of a single tabular grain emulsion contained in each TGREL blends of different tabular grain emulsions can be present. When blended emulsions are employed, at least one is a high bromide tabular grain emulsion as described above. Instead of blending emulsions, it is recognized that the two or more emulsion layers can be coated on each side of the support. At least one of the emulsion layers on each side of the support contains a tabular grain emulsion satisfying the requirements of the invention described above.

The underlying layer units ULU are commonly included to offset reductions in image sharpness attributable to crossover. When light emitted by FLL and BLL exposes the silver halide emulsion(s) on the back and front sides of the support, respectively, a loss of image sharpness results. The relatively high light absorption of spectrally sensitized tabular grain emulsions allows crossover to be reduced to less than 30 percent. By adding dyes to the underlying layer units, crossover can be substantially eliminated. Thus, it is common practice to incorporate microcrystalline dyes in the underlying layer units to reduce or substantially eliminate crossover. If desired, a portion of the silver halide grains relied upon for imaging can be incorporated in the underlying layer units. The use of crossover reducing dyes and the coating of a portion of the silver halide grains in the underlying layer units is described in greater detail in Dickerson U.S. Pat. No. 5,576,156, the disclosure of which is here incorporated by reference. Conventional vehicle materials, such as those disclosed in *Research Disclosure,* Item 38957, II. Vehicles, vehicle extenders, vehicle-like addenda and vehicle related addenda, can be employed in ULU.

The protective layer units PLU are typically provided for physical protection of the underlying emulsion layers. In addition to vehicle features discussed above the protective layer units can contain various addenda to modify the physical properties of the overcoats. Such addenda are illustrated by *Research Disclosure,* Item 38957, IX. Coating physical property modifying addenda, A. Coating aids, B. Plasticizers and lubricants, C. Antistats, and D. Matting agents. It is common practice to divide PLU into a surface overcoat and an interlayer. The interlayers are typically thin hydrophilic colloid layers that provide a separation between the emulsion and the surface overcoat addenda. It is quite common to locate surface overcoat addenda, particularly anti-matte particles, in the interlayers.

EXAMPLES

The following specific embodiments further illustrate the invention.

Grain coating coverages are based on the weight of silver. Speed was measured on the characteristic curve at Dmin+0.2, unless otherwise stated. Speed is reported in relative log units—that is 100 units=1.00 log E, where E is exposure in lux-seconds. In designating coatings, the suffix (c) indicates comparative coatings while the suffix (ex) indicates examples of the invention.

Example 1

A series of coatings were prepared on a 7 mil (179 μm) clear poly(ethylene terephthalate) film support.

Coating A

A silver bromide tabular grain emulsion having a mean ECD of 1.6 μm and a mean tabular grain thickness of 0.13 μm was spectrally sensitized with anhydro-3,3'-bis(3-sulfopropyl)-5,5'-dichloro-9-ethyloxacarbocyanine hydroxide, sodium salt (SS-1) and optimally chemically sensitized with sodium thiosulfate, tetrachloroaurate, and potassium selenocyanate. Potassium iodide in the amount of 300 mg/Ag mole and 1 g/Ag mole of the sodium salt of 4-hydroxy-6-methyl-1,3,3a,7-tetraazaindene were added to the emulsion.

The emulsion was then coated at a silver coverage of 17.2 mg/dm$^2$ and 31.2 mg/dm$^2$ of gelatin. An overcoat of 7.2 mg/dm$^2$ gelatin containing bis(vinylsulfonylmethyl)ether in the amount of 2.2 weight percent, based on the total weight of gelatin in both layers was incorporated as a hardener.

Coating B

Coating A was replicated, except that the category (a) covering power enhancers 4-hydroxy-6-methyl-2-methylmercapto-1,3,3a,7-tetraazaindene (400 mg/Ag mole) and 2-mercapto-1,3-benzothiazole (30 mg/Ag mole) were added.

Coating C

Coating A was replicated, except that 6.4 mg/dm$^2$ of the water soluble polymer dextran (m.w.=40,000), a category (b) covering power enhancer, was added to the emulsion layer.

Coating D

Coating B was replicated, except that 6.4 mg/dm$^2$ of the water soluble polymer dextran (m.w.=40,000), a category (b) covering power enhancer, was added to the emulsion layer.

Coating E

Coating D was replicated, except that the dextran was replaced with an equal amount of the category (b) covering power enhancer polyacrylamide (m.w.=40,000).

Coating F

Coating D was replicated, except that the dextran was replaced with an equal amount of the category (b) covering power enhancer poly(vinyl pyrrolidone (m.w.=40,000).

The coatings were each exposed to a 546 nm mercury emission line and processed using a conventional hydroquinone-Elon™ (p-N-methylaminophenol hemisulfate) developer.

The results of summarized in Table I.

TABLE I

| CE | CPE-(a) | CPE-(b) | CP | b* |
|---|---|---|---|---|
| Ac | No | No | 9.02 | 2.7 |
| Bc | Yes | No | 10.04 | 2.7 |
| Cc | No | DBX | 10.13 | 2.9 |
| Dex | Yes | DEX | 10.78 | 2.2 |

TABLE I-continued

| CE | CPE-(a) | CPE-(b) | CP | b* |
|---|---|---|---|---|
| Eex | Yes | PAA | 10.87 | 2.1 |
| Fc | Yes | PVP | 10.87 | 4.0 |

CE = Coated Element
CPE-(a) and CPE-(b) = category (a) and (b) covering power enhancers
CP = covering power
DEX = dextran
PAA = polyacrylamide
PVP = poly(vinyl pyrrolidone)

From Table I it is apparent that the lowest covering power was obtained when no covering power enhancer was present. When a category (a) covering power enhancer was added, covering power increased while image tone remained unchanged.

When the category (b) covering power enhancer dextran was added without adding a category (a) covering power enhancer, covering power enhancement occurred while image tone became somewhat warmer, as indicated by the higher b* value.

When dextran or polyacrylamide were added to the coatings containing the category (b) covering power enhancer, a further increase in covering power occurred and, quite unexpectedly, a significantly colder image tone was realized. It was entirely unexpected that the combination of the category (a) covering power enhancers and the category (b) covering power enhancers dextran and polyacrylamide would produce a colder image tone than produced by the use of either covering power enhancer alone or in the absence of both covering power enhancers.

Still further, once the image tone improvement realized by using dextran or polyacrylamide with a category (a) covering power enhancer was realized, it was surprising that poly(vinyl pyrrolidone), also a category (b) covering power enhancer, did not produce a colder image tone, but actually produced a large shift toward a warmer image tone.

Example 2

This example in part repeated the coatings and observations of Example 1 and in part substituted the alternative category (a) covering power enhancer 5-(3-ethyl-2[3H]-benzoxazolylidene)-3-phenylrhodanine (RHOD) or substituting for the category (b) covering power enhancer poly (vinyl alcohol) (PVA) or polyethylene glycol (PEG).

The results are summarized in Table II.

TABLE II

| | CPE-(a) | CPE-(b) | SPD | Dmin | CP | b* |
|---|---|---|---|---|---|---|
| Ac | No | No | 179 | 0.05 | 9.02 | 2.42 |
| Bc | Ex. 1 | No | 183 | 0.05 | 9.94 | 2.30 |
| Cex | Ex. 1 | DEX | 179 | 0.05 | 10.69 | 1.78 |
| Dex | Ex. 1 | PAA | 178 | 0.05 | 10.50 | 2.13 |
| Ec | Ex. 1 | PVA | 183 | 0.06 | 10.13 | 2.81 |
| Fc | Ex. 1 | PVP | 181 | 0.06 | 10.59 | 3.33 |
| Gc | Ex. 1 | PEG | 186 | 0.12 | 10.50 | 3.57 |
| Hc | RHOD | No | 178 | 0.06 | 9.76 | 2.39 |
| Iex | RHOD | DEX | 170 | 0.05 | 10.32 | 1.82 |

From Table II it is apparent that the category (a) covering power enhancers in combination with the category (b) covering power enhancer polyacrylamide or dextran improve covering power and produce colder image tones. Substitution of poly(vinyl alcohol), poly(vinyl pyrrolidone) or polyethylene glycol as a category (b) covering power enhancer results in much warmer image tones. Polyethylene glycol also increases fog.

Example 3

Element 3C

A radiographic element was constructed by coating onto both major faces a blue tinted 7 mil (178 μm) poly(ethylene terephthalate) film support (S) an emulsion layer (EL), an interlayer (IL) and a transparent surface overcoat (SOC), as indicated:

| |
|---|
| SOC |
| IL |
| EL |
| S |
| EL |
| IL |
| SOC |

| Contents | Coverage |
|---|---|
| **Emulsion Layer (EL)** | |
| Ag | 18.3 |
| Gelatin | 31.2 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsulfonyl)ether (based on wt. of gelatin in all layers) | 2.4% |
| **Interlayer (IL)** | |
| Gelatin | 3.4 |
| AgI Lippmann | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| **Surface Overcoat (SOC)** | |
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

Except as otherwise noted, all coating coverages above are reported in mg/dm$^2$.

The Ag in EL was provided in the form a thin, high aspect ratio tabular grain silver bromide emulsion in which the tabular grains accounted for greater than 90 percent of total grain projected area, exhibited an average equivalent circular diameter (ECD) of 2.0 μm, an average thickness of 0.10 μm, and an average aspect ratio of 20. The tabular grain emulsion was sulfur and gold sensitized and spectrally sensitized with 590 mg/Ag mole of anhydro-5,5-dichloro-9-ethyl-3,3'-bis(3-sulfopropyl)oxacarbocyanine hydroxide, sodium salt, followed by the addition of 300 mg(Ag mole of KI. The AgI Lippmann emulsion present in IL exhibited a mean ECD of 0.08 μm.

Element 3E

An element was constructed identically as Element 3C, except that following additional materials were included in the emulsion layers:

| Emulsion Layer (EL) | |
|---|---|
| Contents | Coverage |
| 4-Hydroxy-6-methyl-2-methyl-mercapto-1,3,3a,7-tetraazaindene | 400 mg/Ag mole |
| 2-Mercapto-1,3-benzothiazole | 30 mg/Ag mole |
| Dextran | 5.38 |
| Polyacrylamide | 2.69 |
| Carboxymethyl casein | 1.61 |

Sensitometry

Elements 3C and 3E were mounted between a pair of Lanex™ regular intensifying screens and exposed to 70 KVp X-radiation using a 3-phase Picker Medical (Model VTX-650)™ exposure unit containing filtration of up to 3 mm of Al. Sensitometric gradations in exposure were achieved by using a 21 increment (0.1 log E, where E represents exposure in lux-seconds) Al step wedge of varying thickness.

The exposed elements were processed using a Kodak X-Omat™ M6A-N film processor set for a 90 seconds processing cycle:

| | |
|---|---|
| Development | 24 seconds at 40° C. |
| Fixing | 20 seconds at 40° C. |
| Washing | 10 seconds at 40° C. |
| Drying | 20 seconds at 65° C. |

where the time not otherwise accounted for was taken up in transport between stages.

The composition of the developer was as follows:

| | |
|---|---|
| Hydroquinone | 30 g |
| 4-Hydroxymethyl-4-methyl-1-phenyl-3-pyrazolidinone | 1.5 g |
| KOH | 21 g |
| $NaHCO_3$ | 7.5 g |
| $K_2SO_3$ | 44.2 g |
| $Na_2S_2O_5$ | 12.6 g |
| 5-Methylbenzotriazole | 0.06 g |
| Glutaraldehyde | 4.9 g |
| Water to 1 Liter (pH = 10) | |

The covering power of Element 3E was 14 percent higher than that of Element 3C while the image tone of Element 3C was −5.1 versus −5.6 for Element 3E. Thus, Element 3E was superior both in image tone and silver covering power.

The invention has been described in detail with particular reference to preferred embodiments thereof, but it will be understood that variations and modifications can be effected within the spirit and scope of the invention.

What is claimed is:

1. A radiographic element comprised of a transparent film support having first and second major surfaces and, coated on each of the major surfaces of the support, at least one layer containing a tabular grain emulsion including a gelatino-vehicle and silver halide grains having a mean equivalent circular diameter of greater than 0.3 micrometer and containing greater than 50 mole percent bromide and less than 3 mole percent iodide, based on silver, a covering power enhancing compound containing at least one divalent sulfur atom adsorbed to surfaces of the silver halide grains, and a water soluble polymer chosen from the class consisting of polyacrylamide and dextran, in a weight ratio of the polymer to the gelatino-vehicle of at least 0.1:1.

2. A radiographic element according to claim 1 wherein the water soluble polymer is dextran.

3. A radiographic element according to claim 1 wherein the water soluble polymer is polyacrylamide.

4. A radiographic element according to claim 1 wherein the weight ratio of the water soluble polymer to the gelatino-vehicle is in the range of from 0.1:1 to 1:1.

5. A radiographic element according to claim 4 wherein the weight ratio of the water soluble polymer to the gelatino-vehicle is in the range of from 0.25:1 to 0.75:1.

6. A radiographic element according to claim 1 wherein the adsorbed covering power enhancing compound contains an azole or azine ring.

7. A radiographic element according to claim 6 wherein the covering power enhancing compound contains an azole or azine ring having adjacent a trivalent ring nitrogen atom a ring carbon atom that is substituted with a sulfur containing moiety that forms a mercapto substituent of the ring carbon atom or forms with the ring carbon atom a thioxocarbonyl group.

8. A radiographic element according to claim 7 wherein the adsorbed covering power enhancing compound is a mercapto substituted tetrazole or tetraazaindene.

9. A radiographic element according to claim 7 wherein the covering power enhancing compound includes a rhodanine ring.

10. A radiographic element according to claim 7 wherein the adsorbed covering power enhancing compound includes a benzothiazole, benzoxazole or benzimidazole ring.

* * * * *